US006970063B1

(12) United States Patent
Fromm et al.

(10) Patent No.: US 6,970,063 B1
(45) **Date of Patent: *Nov. 29, 2005**

(54) POWER TRANSFORMER/INDUCTOR

(75) Inventors: Udo Fromm, Vasteras (SE); Sven Hornfeldt, Vasteras (SE); Par Holmberg, Vasteras (SE); Gunnar Kylander, Vasteras (SE); Li Ming, Vasteras (SE); Mats Leijon, Vasteras (SE)

(73) Assignee: ABB AB, Vasteras (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/355,801

(22) PCT Filed: Feb. 2, 1998

(86) PCT No.: PCT/SE98/00153

§ 371 (c)(1),
(2), (4) Date: Oct. 14, 1999

(87) PCT Pub. No.: WO98/34245

PCT Pub. Date: Aug. 6, 1998

(30) Foreign Application Priority Data

Feb. 3, 1997 (SE) ..... 9700336
Nov. 28, 1997 (SE) ..... 9704412

(51) Int. Cl.[7] ..... H01F 27/28
(52) U.S. Cl. ..... 336/182; 336/212; 336/205
(58) Field of Search ..... 336/182, 185, 336/212; 174/102 SC, 15.5, 15.6, 15.8

(56) References Cited

U.S. PATENT DOCUMENTS 681,800 A 9/1901 Lasche
847,008 A 3/1907 Kitsee
1,304,451 A 5/1919 Burnham
1,418,856 A 6/1922 Williamson
1,481,585 A 1/1924 Beard
1,508,456 A 9/1924 Lenz
1,728,915 A 9/1929 Blankenship et al.
1,742,985 A 1/1930 Burnham
1,747,507 A 2/1930 George
1,756,672 A 4/1930 Barr
1,762,775 A 6/1930 Ganz
1,781,308 A 11/1930 Vos
1,861,182 A 5/1932 Hendey et al.
1,904,885 A 4/1933 Seeley
1,974,406 A 9/1934 Apple et al.
2,006,170 A 6/1935 Juhlin (Continued)

FOREIGN PATENT DOCUMENTS

AT 399790 7/1995

(Continued)

OTHER PUBLICATIONS

Shipboard Electrical Insulation; G. L. Moses, 1951, pp2&3.

(Continued)

*Primary Examiner*—Anh Mai
(74) *Attorney, Agent, or Firm*—Oblon, Spivak, McClelland, Maier & Neustadt, P.C.

(57) ABSTRACT

The present invention relates to a power transformer/inductor comprising at least one winding. The windings are designed by means of a high-voltage cable, comprising an electric conductor, and around the conductor there is arranged a first semiconducting layer, around the first semiconducting layer there is arranged an insulating layer and around the insulating layer there is arranged a second semiconducting layer. The second semiconducting layer is earthed at or in the vicinity of both ends ($\mathbf{26}_1$, $\mathbf{26}_2$; $\mathbf{28}_1$, $\mathbf{28}_2$) of each winding and furthermore one point between both ends ($\mathbf{26}_1$, $\mathbf{26}_2$; $\mathbf{28}_1$, $\mathbf{28}_2$) is directly earthed.

13 Claims, 5 Drawing Sheets

U.S. PATENT DOCUMENTS

| | | | |
|---|---|---|---|
| 2,206,856 | A | 7/1940 | Shearer |
| 2,217,430 | A | 10/1940 | Baudry |
| 2,241,832 | A | 5/1941 | Wahlquist |
| 2,251,291 | A | 8/1941 | Reichelt |
| 2,256,897 | A | 9/1941 | Davidson et al. |
| 2,295,415 | A | 9/1942 | Monroe |
| 2,409,893 | A | 10/1946 | Pendleton et al. |
| 2,415,652 | A | 2/1947 | Norton |
| 2,424,443 | A | 7/1947 | Evans |
| 2,436,306 | A | 2/1948 | Johnson |
| 2,446,999 | A | 8/1948 | Camilli |
| 2,459,322 | A | 1/1949 | Johnston |
| 2,462,651 | A | 2/1949 | Lord |
| 2,498,238 | A | 2/1950 | Berberich et al. |
| 2,650,350 | A | 8/1953 | Heath |
| 2,721,905 | A | 10/1955 | Monroe |
| 2,749,456 | A | 6/1956 | Luenberger |
| 2,780,771 | A | 2/1957 | Lee |
| 2,846,599 | A | 8/1958 | McAdam |
| 2,885,581 | A | 5/1959 | Pileggi |
| 2,943,242 | A | 6/1960 | Schaschi et al. |
| 2,947,957 | A | 8/1960 | Spindler |
| 2,959,699 | A | 11/1960 | Smith et al. |
| 2,962,679 | A | 11/1960 | Stratton |
| 2,975,309 | A | 3/1961 | Seidner |
| 3,014,139 | A | 12/1961 | Shildneck |
| 3,098,893 | A | 7/1963 | Pringle et al. |
| 3,130,335 | A | 4/1964 | Rejda |
| 3,143,269 | A | 8/1964 | Eldik |
| 3,157,806 | A | 11/1964 | Wiedemann |
| 3,158,770 | A | 11/1964 | Coggeshall et al. |
| 3,197,723 | A | 7/1965 | Dortort |
| 3,268,766 | A | 8/1966 | Amos |
| 3,304,599 | A | 2/1967 | Nordin |
| 3,354,331 | A | 11/1967 | Broeker et al. |
| 3,365,657 | A | 1/1968 | Webb |
| 3,372,283 | A | 3/1968 | Jaecklin |
| 3,392,779 | A | 7/1968 | Tilbrook |
| 3,411,027 | A | 11/1968 | Rosenberg |
| 3,418,530 | A | 12/1968 | Cheever |
| 3,435,262 | A | 3/1969 | Bennett et al. |
| 3,437,858 | A | 4/1969 | White |
| 3,444,407 | A | 5/1969 | Yates |
| 3,447,002 | A | 5/1969 | Ronnevig |
| 3,484,690 | A | 12/1969 | Wald |
| 3,541,221 | A | 11/1970 | Aupoix et al. |
| 3,560,777 | A | 2/1971 | Moeller |
| 3,571,690 | A | 3/1971 | Lataisa |
| 3,593,123 | A | 7/1971 | Williamson |
| 3,631,519 | A | 12/1971 | Salahshourian |
| 3,644,662 | A | 2/1972 | Salahshourian |
| 3,651,244 | A | 3/1972 | Silver at al. |
| 3,651,402 | A | 3/1972 | Leffmann |
| 3,660,721 | A | 5/1972 | Baird |
| 3,666,876 | A | 5/1972 | Forster |
| 3,670,192 | A | 6/1972 | Andersson et al. |
| 3,675,056 | A | 7/1972 | Lenz |
| 3,684,821 | A | 8/1972 | Miyauchi et al. |
| 3,684,906 | A | 8/1972 | Lexz |
| 3,699,238 | A | 10/1972 | Hansen at al. |
| 3,716,652 | A | 2/1973 | Lusk et al. |
| 3,716,719 | A | 2/1973 | Angelery et al. |
| 3,727,085 | A | 4/1973 | Goetz et al. |
| 3,740,600 | A | 6/1973 | Turley |
| 3,743,867 | A | 7/1973 | Smith, Jr. |
| 3,746,954 | A | 7/1973 | Myles et al. |
| 3,758,699 | A | 9/1973 | Lusk et al. |
| 3,778,891 | A | 12/1973 | Amasino et al. |
| 3,781,739 | A | 12/1973 | Meyer |
| 3,787,607 | A | 1/1974 | Schlafly |
| 3,792,399 | A | 2/1974 | McLyman |
| 3,801,843 | A | 4/1974 | Corman et al. |
| 3,809,933 | A | 5/1974 | Sugawara et al. |
| 3,813,764 | A | 6/1974 | Tanaka et al. |
| 3,820,048 | A | 6/1974 | Ohta et al. |
| 3,828,115 | A | 8/1974 | Hvizd, Jr. |
| 3,881,647 | A | 5/1975 | Wolfe |
| 3,884,154 | A | 5/1975 | Marten |
| 3,891,880 | A | 6/1975 | Britsch |
| 3,902,000 | A | 8/1975 | Forsyth et al. |
| 3,912,957 | A | 10/1975 | Reynolds |
| 3,932,779 | A | 1/1976 | Madsen |
| 3,932,791 | A | 1/1976 | Oswald |
| 3,943,392 | A | 3/1976 | Keuper et al. |
| 3,947,278 | A | 3/1976 | Youtsey |
| 3,965,408 | A | 6/1976 | Higuchi et al. |
| 3,968,388 | A | 7/1976 | Lambrecht et al. |
| 3,971,543 | A | 7/1976 | Shanahan |
| 3,974,314 | A | 8/1976 | Fuchs |
| 3,993,860 | A | 11/1976 | Snow et al. |
| 3,995,785 | A | 12/1976 | Arick et al. |
| 4,001,616 | A | 1/1977 | Lonseth et al. |
| 4,008,367 | A | 2/1977 | Sunderhauf |
| 4,008,409 | A | 2/1977 | Rhudy et al. |
| 4,031,310 | A | 6/1977 | Jachimowicz |
| 4,039,740 | A | 8/1977 | Iwata |
| 4,041,431 | A | 8/1977 | Enoksen |
| 4,047,138 | A | 9/1977 | Steigerwald |
| 4,064,419 | A | 12/1977 | Peterson |
| 4,084,307 | A | 4/1978 | Schultz et al. |
| 4,085,347 | A | 4/1978 | Lichius |
| 4,088,953 | A | 5/1978 | Sarian |
| 4,091,138 | A | 5/1978 | Takagi et al. |
| 4,091,139 | A | 5/1978 | Quirk |
| 4,099,227 | A | 7/1978 | Liptak |
| 4,103,075 | A | 7/1978 | Adam |
| 4,106,069 | A | 8/1978 | Trautner et al. |
| 4,107,092 | A | 8/1978 | Carnahan et al. |
| 4,109,098 | A | 8/1978 | Olsson et al. |
| 4,121,148 | A | 10/1978 | Platzer |
| 4,132,914 | A | 1/1979 | Khutoretsky |
| 4,134,036 | A | 1/1979 | Curtiss |
| 4,134,055 | A | 1/1979 | Akamatsu |
| 4,134,146 | A | 1/1979 | Stetson |
| 4,149,101 | A | 4/1979 | Lesokhin et al. |
| 4,152,615 | A | 5/1979 | Calfo et al. |
| 4,160,193 | A | 7/1979 | Richmond |
| 4,164,672 | A | 8/1979 | Flick |
| 4,164,772 | A | 8/1979 | Hingorani |
| 4,177,397 | A | 12/1979 | Lill |
| 4,177,418 | A | 12/1979 | Brueckner et al. |
| 4,184,186 | A | 1/1980 | Barkan |
| 4,200,817 | A | 4/1980 | Bratoljic |
| 4,200,818 | A | 4/1980 | Ruffing et al. |
| 4,206,434 | A | 6/1980 | Hase |
| 4,207,427 | A | 6/1980 | Beretta et al. |
| 4,207,482 | A | 6/1980 | Neumeyer et al. |
| 4,208,597 | A | 6/1980 | Mulach et al. |
| 4,229,721 | A | 10/1980 | Koloczek et al. |
| 4,238,339 | A | 12/1980 | Khutoretsky et al. |
| 4,239,999 | A | 12/1980 | Vinokurov et al. |
| 4,245,182 | A | 1/1981 | Aotsu et al. |
| 4,246,694 | A | 1/1981 | Raschbichler et al. |
| 4,255,684 | A | 3/1981 | Mischler et al. |
| 4,258,280 | A | 3/1981 | Starcevic |
| 4,262,209 | A | 4/1981 | Berner |
| 4,274,027 | A | 6/1981 | Higuchi et al. |
| 4,281,264 | A | 7/1981 | Keim et al. |
| 4,292,558 | A | 9/1981 | Flick et al. |
| 4,307,311 | A | 12/1981 | Grozinger |
| 4,308,476 | A | 12/1981 | Schuler |
| 4,308,575 | A | 12/1981 | Mase |
| 4,310,966 | A | 1/1982 | Breitenbach |
| 4,314,168 | A | 2/1982 | Breitenbach |

4,317,001 A 2/1982 Silver et al.
4,320,645 A 3/1982 Stanley
4,321,426 A 3/1982 Schaeffer
4,321,518 A 3/1982 Akamatsu
4,326,181 A 4/1982 Allen
4,330,726 A 5/1982 Albright et al.
4,337,922 A 7/1982 Streiff et al.
4,341,989 A 7/1982 Sandberg et al.
4,345,804 A * 8/1982 Lanoue ..... 349/33
4,347,449 A 8/1982 Beau
4,347,454 A 8/1982 Gellert et al.
4,357,542 A 11/1982 Kirschbaum
4,360,748 A 11/1982 Raschbichler et al.
4,361,723 A 11/1982 Hvizd, Jr. et al.
4,363,612 A 12/1982 Walchhutter
4,365,178 A 12/1982 Lexz
4,367,425 A 1/1983 Mendelsohn et al.
4,367,890 A 1/1983 Spirk
4,368,418 A 1/1983 Demello et al.
4,369,389 A 1/1983 Lambrecht
4,371,745 A 2/1983 Sakashita
4,384,944 A 5/1983 Silver et al.
4,387,316 A 6/1983 Katsekas
4,401,920 A 8/1983 Taylor et al.
4,403,163 A 9/1983 Armerding et al.
4,404,486 A 9/1983 Keim et al.
4,411,710 A 10/1983 Mochizuki et al.
4,421,284 A 12/1983 Pan
4,425,521 A 1/1984 Rosenberry, Jr. et al.
4,426,771 A 1/1984 Wang et al.
4,429,244 A 1/1984 Nikitin et al.
4,431,960 A 2/1984 Zucker
4,432,029 A 2/1984 Lundqvist
4,437,464 A 3/1984 Crow
4,443,725 A 4/1984 Derderian et al.
4,470,884 A 9/1984 Carr
4,473,765 A 9/1984 Butman, Jr. et al.
4,475,075 A 10/1984 Munn
4,477,690 A 10/1984 Nikitin et al.
4,481,438 A 11/1984 Keim
4,484,106 A 11/1984 Taylor et al.
4,488,079 A 12/1984 Dailey et al.
4,490,651 A 12/1984 Taylor et al.
4,503,284 A 3/1985 Minnick et al.
4,508,251 A 4/1985 Harada et al.
4,510,077 A 4/1985 Elton
4,517,471 A 5/1985 Sachs
4,520,287 A 5/1985 Wang et al.
4,523,249 A 6/1985 Arimoto
4,538,131 A 8/1985 Baier et al.
4,546,210 A 10/1985 Akiba et al.
4,551,780 A 11/1985 Canay
4,552,990 A 11/1985 Persson et al.
4,557,038 A 12/1985 Wcislo et al.
4,560,896 A 12/1985 Vogt et al.
4,565,929 A 1/1986 Baskin et al.
4,571,453 A 2/1986 Takaoka et al.
4,588,916 A 5/1986 Lis
4,590,416 A 5/1986 Porche et al.
4,594,630 A 6/1986 Rabinowitz et al.
4,607,183 A 8/1986 Rieber et al.
4,615,109 A 10/1986 Wcislo et al.
4,615,778 A 10/1986 Elton
4,618,795 A 10/1986 Cooper et al.
4,619,040 A 10/1986 Wang et al.
4,622,116 A 11/1986 Elton et al.
4,633,109 A 12/1986 Feigel
4,650,924 A 3/1987 Kauffman et al.
4,652,963 A 3/1987 Fahlen
4,656,316 A 4/1987 Meltsch
4,656,379 A 4/1987 McCarty
4,663,603 A 5/1987 van Riemsdijk et al.
4,677,328 A 6/1987 Kumakura
4,687,882 A 8/1987 Stone et al.
4,692,731 A 9/1987 Osinga
4,723,083 A 2/1988 Elton
4,723,104 A 2/1988 Rohatyn
4,724,345 A 2/1988 Elton et al.
4,732,412 A 3/1988 van der Linden et al.
4,737,704 A 4/1988 Kalinnikov et al.
4,745,314 A 5/1988 Nakano
4,761,602 A 8/1988 Leibovich
4,766,365 A 8/1988 Bolduc et al.
4,771,168 A 9/1988 Gundersen et al.
4,785,138 A 11/1988 Breitenbach et al.
4,795,933 A 1/1989 Sakai
4,827,172 A 5/1989 Kobayashi
4,845,308 A 7/1989 Womack, Jr. et al.
4,847,747 A 7/1989 Abbondanti
4,853,565 A 8/1989 Elton et al.
4,859,810 A 8/1989 Cloetens et al.
4,859,989 A 8/1989 McPherson
4,860,430 A 8/1989 Raschbichler et al.
4,864,266 A 9/1989 Feather et al.
4,883,230 A 11/1989 Lindstrom
4,890,040 A 12/1989 Gundersen
4,894,284 A 1/1990 Yamanouchi et al.
4,914,386 A 4/1990 Zocholl
4,918,347 A 4/1990 Takaba
4,918,835 A 4/1990 Raschbichler et al.
4,924,342 A 5/1990 Lee
4,926,079 A 5/1990 Niemela et al.
4,942,326 A 7/1990 Butler, III et al.
4,949,001 A 8/1990 Campbell
4,982,147 A 1/1991 Lauw
4,988,949 A * 1/1991 Boenning et al. ..... 324/541
4,994,952 A 2/1991 Silva et al.
4,997,995 A 3/1991 Simmons et al.
5,012,125 A 4/1991 Conway
5,030,813 A 7/1991 Stanisz
5,036,165 A * 7/1991 Elton et al. ..... 174/102 CS
5,036,238 A 7/1991 Tajima
5,066,881 A 11/1991 Elton et al.
5,067,046 A 11/1991 Elton et al.
5,083,360 A 1/1992 Valencic et al.
5,086,246 A 2/1992 Dymond et al.
5,091,609 A 2/1992 Sawada et al.
5,094,703 A 3/1992 Takaoka et al.
5,095,175 A 3/1992 Yoshida et al.
5,097,241 A 3/1992 Smith et al.
5,097,591 A 3/1992 Wcislo et al.
5,111,095 A 5/1992 Hendershot
5,124,607 A 6/1992 Rieber et al.
5,136,459 A 8/1992 Fararooy
5,140,290 A 8/1992 Dersch
5,153,460 A 10/1992 Bovino et al.
5,168,662 A 12/1992 Nakamura et al.
5,171,941 A 12/1992 Shimizu et al.
5,175,396 A 12/1992 Emery et al.
5,182,537 A 1/1993 Thuis
5,187,428 A 2/1993 Hutchison et al.
5,231,249 A 7/1993 Kimura et al.
5,235,488 A 8/1993 Koch
5,246,783 A 9/1993 Spenadel et al.
5,264,778 A 11/1993 Kimmel et al.
5,287,262 A 2/1994 Klein
5,239,146 A 3/1994 Aosaki et al.
5,304,883 A 4/1994 Denk
5,305,961 A 4/1994 Errard et al.
5,321,308 A 6/1994 Johncock
5,323,330 A 6/1994 Asplund et al.
5,325,008 A 6/1994 Grant
5,325,259 A 6/1994 Paulsson
5,327,637 A 7/1994 Breitenbach et al.
5,341,281 A 8/1994 Skibinski
5,343,139 A 8/1994 Gyugyi et al.

| | | | |
|---|---|---|---|
| 5,355,046 | A | 10/1994 | Weigelt |
| 5,365,132 | A | 11/1994 | Hann et al. |
| 5,387,890 | A | 2/1995 | Estop et al. |
| 5,397,513 | A | 3/1995 | Steketee, Jr. |
| 5,399,941 | A | 3/1995 | Grothaus et al. |
| 5,400,005 | A | 3/1995 | Bobry |
| 5,408,169 | A | 4/1995 | Jeanneret |
| 5,449,861 | A | 9/1995 | Fujino et al. |
| 5,452,170 | A | 9/1995 | Ohde et al. |
| 5,468,916 | A | 11/1995 | Litenas et al. |
| 5,499,178 | A | 3/1996 | Mohan |
| 5,500,632 | A | 3/1996 | Halser, III |
| 5,510,942 | A | 4/1996 | Bock et al. |
| 5,530,307 | A | 6/1996 | Horst |
| 5,533,658 | A | 7/1996 | Benedict et al. |
| 5,534,754 | A | 7/1996 | Poumey |
| 5,545,853 | A | 8/1996 | Hildreth |
| 5,550,410 | A | 8/1996 | Titus |
| 5,583,387 | A | 12/1996 | Takeuchi et al. |
| 5,587,126 | A | 12/1996 | Steketee, Jr. |
| 5,598,137 | A | 1/1997 | Alber et al. |
| 5,607,320 | A | 3/1997 | Wright |
| 5,612,510 | A | 3/1997 | Hildreth |
| 5,663,605 | A | 9/1997 | Evans et al. |
| 5,672,926 | A | 9/1997 | Brandes et al. |
| 5,689,223 | A | 11/1997 | Demarmels et al. |
| 5,807,447 | A | 9/1998 | Forrest |
| 5,834,699 | A | 11/1998 | Buck et al. |

FOREIGN PATENT DOCUMENTS

| | | | |
|---|---|---|---|
| BE | 565063 | | 2/1957 |
| CH | 391071 | | 4/1965 |
| CH | 534448 | | 2/1973 |
| CH | 539328 | | 7/1973 |
| CH | 657482 | | 8/1986 |
| DD | 137164 | | 8/1979 |
| DD | 138840 | | 11/1979 |
| DE | 40414 | | 8/1887 |
| DE | 134022 | | 12/1901 |
| DE | 277012 | | 7/1914 |
| DE | 336418 | | 6/1920 |
| DE | 372390 | | 3/1923 |
| DE | 386561 | | 12/1923 |
| DE | 387973 | | 1/1924 |
| DE | 406371 | | 11/1924 |
| DE | 425551 | | 2/1926 |
| DE | 426793 | | 3/1926 |
| DE | 432169 | | 7/1926 |
| DE | 433749 | | 9/1926 |
| DE | 435608 | | 10/1926 |
| DE | 435609 | | 10/1926 |
| DE | 441717 | | 3/1927 |
| DE | 443011 | | 4/1927 |
| DE | 460124 | | 5/1928 |
| DE | 482506 | | 9/1929 |
| DE | 501181 | | 7/1930 |
| DE | 523047 | | 4/1931 |
| DE | 568508 | | 1/1933 |
| DE | 5720030 | | 3/1933 |
| DE | 584639 | | 9/1933 |
| DE | 586121 | | 10/1933 |
| DE | 604972 | | 11/1934 |
| DE | 629301 | | 4/1936 |
| DE | 719009 | | 3/1942 |
| DE | 846583 | | 8/1952 |
| DE | 875227 | | 4/1953 |
| DE | 975999 | | 1/1963 |
| DE | 1465719 | | 5/1969 |
| DE | 1807391 | | 5/1970 |
| DE | 2050674 | | 5/1971 |
| DE | 1638176 | | 6/1971 |
| DE | 2155371 | | 5/1973 |
| DE | 2400698 | | 7/1975 |
| DE | 2520511 | | 11/1976 |
| DE | 2656389 | | 6/1978 |
| DE | 2721905 | | 11/1978 |
| DE | 2824951 | | 12/1979 |
| DE | 2835386 | | 2/1980 |
| DE | 2839517 | | 3/1980 |
| DE | 2854520 | | 6/1980 |
| DE | 3009102 | | 9/1980 |
| DE | 2913697 | | 10/1980 |
| DE | 2920478 | | 12/1980 |
| DE | 3028777 | | 3/1981 |
| DE | 2939004 | | 4/1981 |
| DE | 3006382 | | 8/1981 |
| DE | 3008819 | | 9/1981 |
| DE | 209313 | | 4/1984 |
| DE | 3305225 | | 8/1984 |
| DE | 3309051 | | 9/1984 |
| DE | 3441311 | | 5/1986 |
| DE | 3543106 | | 6/1987 |
| DE | 2917717 | | 8/1987 |
| DE | 3612112 | | 10/1987 |
| DE | 3726346 | | 2/1989 |
| DE | 3925337 | | 2/1991 |
| DE | 4023903 | | 11/1991 |
| DE | 4022476 | | 1/1992 |
| DE | 4233558 | | 3/1994 |
| DE | 4402184 | | 8/1995 |
| DE | 4409794 | | 8/1995 |
| DE | 4412761 | | 10/1995 |
| DE | 4420322 | | 12/1995 |
| DE | 19620906 | | 1/1996 |
| DE | 4438186 | | 5/1996 |
| DE | 19020222 | | 3/1997 |
| DE | 19547229 | | 6/1997 |
| DE | 468827 | | 7/1997 |
| EP | 049104 | | 4/1982 |
| EP | 04993704 | | 4/1982 |
| EP | 0056580 | A1 | 7/1982 |
| EP | 078908 | | 5/1983 |
| EP | 0120154 | | 10/1984 |
| EP | 0130124 | | 1/1985 |
| EP | 0142813 | | 5/1985 |
| EP | 0155405 | | 9/1985 |
| EP | 0102513 | | 1/1986 |
| EP | 0174783 | | 3/1986 |
| EP | 0185788 | | 7/1986 |
| EP | 0277358 | | 8/1986 |
| EP | 0234521 | | 9/1987 |
| EP | 0244069 | | 11/1987 |
| EP | 0246377 | | 11/1987 |
| EP | 0265868 | | 5/1988 |
| EP | 0274691 | | 7/1988 |
| EP | 0280759 | | 9/1988 |
| EP | 0282876 | | 9/1988 |
| EP | 0309096 | | 3/1989 |
| EP | 0314860 | | 5/1989 |
| EP | 0316911 | | 5/1989 |
| EP | 0317248 | | 5/1989 |
| EP | 0335430 | | 10/1989 |
| EP | 0342554 | | 11/1989 |
| EP | 0221404 | | 5/1990 |
| EP | 0375101 | | 6/1990 |
| EP | 0406437 | | 1/1991 |
| EP | 0439410 | | 7/1991 |
| EP | 0440865 | | 8/1991 |
| EP | 0469155 | A1 | 2/1992 |
| EP | 0490705 | | 6/1992 |
| EP | 0503817 | | 9/1992 |
| EP | 0571155 | | 11/1993 |
| EP | 0620570 | | 10/1994 |
| EP | 0620630 | | 10/1994 |
| EP | 0642027 | | 3/1995 |

| | | | |
|---|---|---|---|
| EP | 0671632 | | 9/1995 |
| EP | 0676777 | | 10/1995 |
| EP | 0677915 | | 10/1995 |
| EP | 0684579 | | 11/1995 |
| EP | 0684582 | | 11/1995 |
| EP | 0695019 | | 1/1996 |
| EP | 0732787 | | 9/1996 |
| EP | 0738034 | | 10/1996 |
| EP | 0739087 | A2 | 10/1996 |
| EP | 0740315 | | 10/1996 |
| EP | 0749190 | A2 | 12/1996 |
| EP | 0751505 | | 1/1997 |
| EP | 0739087 | A3 | 3/1997 |
| EP | 0749193 | A3 | 3/1997 |
| EP | 0780926 | | 6/1997 |
| EP | 0802542 | | 10/1997 |
| EP | 0913912 | A1 | 5/1999 |
| FR | 805544 | | 4/1936 |
| FR | 841351 | | 7/1938 |
| FR | 847899 | | 12/1938 |
| FR | 916959 | | 12/1946 |
| FR | 1011924 | | 4/1949 |
| FR | 1126975 | | 3/1955 |
| FR | 1238795 | | 7/1959 |
| FR | 2108171 | | 5/1972 |
| FR | 2251938 | | 6/1975 |
| FR | 2305879 | | 10/1976 |
| FR | 2376542 | | 7/1978 |
| FR | 2481531 | | 10/1981 |
| FR | 2467502 | | 4/1984 |
| FR | 2556446 | | 6/1985 |
| FR | 2594271 | | 8/1987 |
| FR | 2708157 | | 1/1995 |
| GB | 123906 | | 3/1919 |
| GB | 268271 | | 3/1927 |
| GB | 292999 | | 4/1929 |
| GB | 319313 | | 7/1929 |
| GB | 518993 | | 3/1940 |
| GB | 537609 | | 6/1941 |
| GB | 540456 | | 10/1941 |
| GB | 589071 | | 6/1947 |
| GB | 666883 | | 2/1952 |
| GB | 685416 | | 1/1953 |
| GB | 702892 | | 1/1954 |
| GB | 715226 | | 9/1954 |
| GB | 723457 | | 2/1955 |
| GB | 739962 | | 11/1955 |
| GB | 763761 | | 12/1956 |
| GB | 805721 | | 12/1958 |
| GB | 827600 | | 2/1960 |
| GB | 854728 | | 11/1960 |
| GB | 870583 | | 6/1961 |
| GB | 913386 | | 12/1962 |
| GB | 965741 | | 8/1964 |
| GB | 992249 | | 6/1965 |
| GB | 1024583 | | 3/1966 |
| GB | 1053337 | | 12/1966 |
| GB | 1059123 | | 1/1967 |
| GB | 1103098 | | 2/1968 |
| GB | 1103099 | | 2/1968 |
| GB | 117401 | | 6/1968 |
| GB | 1135242 | | 12/1968 |
| GB | 1147049 | | 4/1969 |
| GB | 1157885 | | 7/1969 |
| GB | 1174659 | | 12/1969 |
| GB | 1236082 | | 6/1971 |
| GB | 1268770 | | 3/1972 |
| GB | 1319257 | | 6/1973 |
| GB | 1322433 | | 7/1973 |
| GB | 1340983 | | 12/1973 |
| GB | 1341050 | | 12/1973 |
| GB | 1365191 | | 8/1974 |
| GB | 1395152 | | 5/1975 |
| GB | 1424982 | | 2/1976 |
| GB | 1426594 | | 3/1976 |
| GB | 1438610 | | 6/1976 |
| GB | 1445284 | | 8/1976 |
| GB | 1479904 | | 7/1977 |
| GB | 1493163 | | 11/1977 |
| GB | 1502938 | | 3/1978 |
| GB | 1525745 | | 9/1978 |
| GB | 20000625 | | 1/1979 |
| GB | 1548633 | | 7/1979 |
| GB | 2046142 | | 11/1979 |
| GB | 2022327 | | 12/1979 |
| GB | 2025150 | | 1/1980 |
| GB | 2034101 | | 5/1980 |
| GB | 1574796 | | 9/1980 |
| GB | 2070341 | | 9/1981 |
| GB | 2070470 | | 9/1981 |
| GB | 2071433 | | 9/1981 |
| GB | 2081523 | | 2/1982 |
| GB | 2099635 | | 12/1982 |
| GB | 2105925 | | 3/1983 |
| GB | 2106306 | | 4/1983 |
| GB | 2106721 | | 4/1983 |
| GB | 2136214 | | 9/1984 |
| GB | 2140195 | | 11/1984 |
| GB | 2150153 | | 6/1985 |
| GB | 2268337 | | 1/1994 |
| GB | 2273819 | | 6/1994 |
| GB | 2283133 | | 4/1995 |
| GB | 2289992 | | 12/1995 |
| GB | 2308490 | | 6/1997 |
| GB | 2332557 | | 6/1999 |
| HU | 175494 | | 11/1981 |
| JP | 60206121 | | 3/1959 |
| JP | 570435529 | | 8/1980 |
| JP | 57126117 | | 5/1982 |
| JP | 59076156 | | 10/1982 |
| JP | 59159642 | | 2/1983 |
| JP | 6264964 | | 9/1985 |
| JP | 1129737 | | 5/1989 |
| JP | 62320631 | | 6/1989 |
| JP | 2017474 | | 1/1990 |
| JP | 3245748 | | 2/1990 |
| JP | 4179107 | | 11/1990 |
| JP | 318253 | | 1/1991 |
| JP | 424909 | | 1/1992 |
| JP | 5290947 | | 4/1992 |
| JP | 6196343 | | 12/1992 |
| JP | 6233442 | | 2/1993 |
| JP | 6325629 | | 5/1993 |
| JP | 7057951 | | 8/1993 |
| JP | 7264789 | | 3/1994 |
| JP | 8167332 | | 12/1994 |
| JP | 7161270 | | 6/1995 |
| JP | 82664039 | | 11/1995 |
| JP | 9200989 | | 1/1996 |
| JP | 8036952 | | 2/1996 |
| JP | 8167360 | | 6/1996 |
| JP | 2000195345 | A * | 7/2000 |
| LU | 67199 | | 3/1972 |
| SE | 90308 | | 9/1937 |
| SE | 305899 | | 11/1968 |
| SE | 255156 | | 2/1969 |
| SE | 341428 | | 12/1971 |
| SE | 453236 | | 1/1982 |
| SE | 457792 | | 6/1987 |
| SE | 502417 | | 12/1993 |
| SH | SU 266037 | | 10/1965 |
| SH | SU 646403 | | 2/1979 |
| SH | SU 1189322 | | 10/1986 |
| SU | 792302 | | 1/1971 |
| SU | 425268 | | 9/1974 |
| SU | 1019553 | | 1/1980 |

| | | |
|---|---|---|
| SU | 694939 | 1/1982 |
| SU | 955369 | 8/1983 |
| SU | 1511810 | 5/1987 |
| WO | WO8202617 | 8/1982 |
| WO | WO8502302 | 5/1985 |
| WO | WO9011389 | 10/1990 |
| WO | WO9012409 | 10/1990 |
| WO | PCT/DE 90/00279 | 11/1990 |
| WO | WO9101059 | 1/1991 |
| WO | WO9101585 | 2/1991 |
| WO | WO9107807 | 3/1991 |
| WO | PCT SE 91/00077 | 4/1991 |
| WO | WO9109442 | 6/1991 |
| WO | WO 91/11841 | 8/1991 |
| WO | WO 91/15755 | 10/1991 |
| WO | WO8115862 | 10/1991 |
| WO | WO9201328 | 1/1992 |
| WO | WO9203870 | 3/1992 |
| WO | WO9321681 | 10/1993 |
| WO | WO9406194 | 3/1994 |
| WO | WO9518058 | 7/1995 |
| WO | WO95022153 | 8/1995 |
| WO | WO9524049 | 9/1995 |
| WO | WO9622606 | 7/1996 |
| WO | WO9622607 | 7/1996 |
| WO | PCT/CN 96/00010 | 10/1996 |
| WO | WO9630144 | 10/1996 |
| WO | WO9710640 | 3/1997 |
| WO | WO9711831 | 4/1997 |
| WO | WO9716881 | 5/1997 |
| WO | WO 97/29494 | 8/1997 |
| WO | WO 97/45908 | 12/1997 |
| WO | WO9745288 | 12/1997 |
| WO | WO9745847 | 12/1997 |
| WO | WO9745848 | 12/1997 |
| WO | WO9745906 | 12/1997 |
| WO | WO 9745907 | 12/1997 |
| WO | WO9745912 | 12/1997 |
| WO | WO9745914 | 12/1997 |
| WO | WO9745915 | 12/1997 |
| WO | WO9745916 | 12/1997 |
| WO | WO9745918 | 12/1997 |
| WO | WO9745919 | 12/1997 |
| WO | WO9745920 | 12/1997 |
| WO | WO9745921 | 12/1997 |
| WO | WO9745922 | 12/1997 |
| WO | WO9745923 | 12/1997 |
| WO | WO9745924 | 12/1997 |
| WO | WO9745925 | 12/1997 |
| WO | WO9745926 | 12/1997 |
| WO | WO9745927 | 12/1997 |
| WO | WO9745928 | 12/1997 |
| WO | WO9745929 | 12/1997 |
| WO | WO9745930 | 12/1997 |
| WO | WO9745931 | 12/1997 |
| WO | WO9745932 | 12/1997 |
| WO | WO9745933 | 12/1997 |
| WO | WO9745934 | 12/1997 |
| WO | WO9745935 | 12/1997 |
| WO | WO9745936 | 12/1997 |
| WO | WO9745937 | 12/1997 |
| WO | WO9745938 | 12/1997 |
| WO | WO9745939 | 12/1997 |
| WO | WO9747067 | 12/1997 |
| WO | WO 98/20598 | 5/1998 |
| WO | WO 98/20602 | 5/1998 |
| WO | WO9820500 | 5/1998 |
| WO | WO9820595 | 5/1998 |
| WO | WO9820596 | 5/1998 |
| WO | WO9820597 | 5/1998 |
| WO | PCT/FR 98/00468 | 6/1998 |
| WO | WO9827634 | 6/1998 |
| WO | WO9827635 | 6/1998 |
| WO | WO9827636 | 6/1998 |
| WO | WO9829927 | 7/1998 |
| WO | WO9829928 | 7/1998 |
| WO | WO9829929 | 7/1998 |
| WO | WO9829930 | 7/1998 |
| WO | WO9829931 | 7/1998 |
| WO | WO9829932 | 7/1998 |
| WO | WO 98/34239 | 8/1998 |
| WO | WO9833731 | 8/1998 |
| WO | WO9833736 | 8/1998 |
| WO | WO9833737 | 8/1998 |
| WO | WO9834238 | 8/1998 |
| WO | WO9834240 | 8/1998 |
| WO | WO9834241 | 8/1998 |
| WO | WO9834242 | 8/1998 |
| WO | WO9834243 | 8/1998 |
| WO | WO9834244 | 8/1998 |
| WO | WO9834245 | 8/1998 |
| WO | WO9834246 | 8/1998 |
| WO | WO9834247 | 8/1998 |
| WO | WO9834248 | 8/1998 |
| WO | WO9834249 | 8/1998 |
| WO | WO9834250 | 8/1998 |
| WO | WO9834309 | 8/1998 |
| WO | WO9834312 | 8/1998 |
| WO | WO9834315 | 8/1998 |
| WO | WO9834321 | 8/1998 |
| WO | WO9834322 | 8/1998 |
| WO | WO9834323 | 8/1998 |
| WO | WO9834325 | 8/1998 |
| WO | WO9834326 | 8/1998 |
| WO | WO9834327 | 8/1998 |
| WO | WO9834328 | 8/1998 |
| WO | WO9834329 | 8/1998 |
| WO | WO9834330 | 8/1998 |
| WO | WO9834331 | 8/1998 |
| WO | WO 98/40627 | 9/1998 |
| WO | WO 98/43336 | 10/1998 |
| WO | WO9917309 | 4/1999 |
| WO | WO9917311 | 4/1999 |
| WO | WO9917312 | 4/1999 |
| WO | WO9917313 | 4/1999 |
| WO | WO9917314 | 4/1999 |
| WO | WO9917315 | 4/1999 |
| WO | WO9917316 | 4/1999 |
| WO | WO9917422 | 4/1999 |
| WO | WO9917424 | 4/1999 |
| WO | WO9917425 | 4/1999 |
| WO | WO9917426 | 4/1999 |
| WO | WO9917427 | 4/1999 |
| WO | WO9917428 | 4/1999 |
| WO | WO9917429 | 4/1999 |
| WO | WO9917432 | 4/1999 |
| WO | WO9917433 | 4/1999 |
| WO | WO9919963 | 4/1999 |
| WO | WO9919969 | 4/1999 |
| WO | WO9919970 | 4/1999 |
| WO | PCT/SE 98/02148 | 6/1999 |
| WO | WO 99/28922 | 6/1999 |
| WO | WO 99/29005 | 6/1999 |
| WO | WO 99/29023 | 6/1999 |
| WO | WO 99/29025 | 6/1999 |
| WO | WO9927546 | 6/1999 |
| WO | WO9928919 | 6/1999 |
| WO | WO9928921 | 6/1999 |
| WO | WO9928923 | 6/1999 |
| WO | WO9928924 | 6/1999 |
| WO | WO9928925 | 6/1999 |
| WO | WO9928926 | 6/1999 |
| WO | WO9928927 | 6/1999 |
| WO | WO9928928 | 6/1999 |
| WO | WO9928929 | 6/1999 |
| WO | WO9928930 | 6/1999 |

| | | |
|---|---|---|
| WO | WO9928931 | 6/1999 |
| WO | WO9928934 | 6/1999 |
| WO | WO9928994 | 6/1999 |
| WO | WO9929005 | 6/1999 |
| WO | WO9929008 | 6/1999 |
| WO | WO9929011 | 6/1999 |
| WO | WO9929012 | 6/1999 |
| WO | WO9929013 | 6/1999 |
| WO | WO9929014 | 6/1999 |
| WO | WO9929015 | 6/1999 |
| WO | WO9929016 | 6/1999 |
| WO | WO9929017 | 6/1999 |
| WO | WO9929018 | 6/1999 |
| WO | WO9929019 | 6/1999 |
| WO | WO9929020 | 6/1999 |
| WO | WO9929021 | 6/1999 |
| WO | WO9929022 | 6/1999 |
| WO | WO9929024 | 6/1999 |
| WO | WO9929026 | 6/1999 |
| WO | WO9929029 | 6/1999 |
| WO | WO9929034 | 6/1999 |

OTHER PUBLICATIONS

ABB Elkrafthandbok; ABB AB; 1988 ; pp247-276.
Elkraft teknisk Handbok, 2 Elmaskiner; A. Alfredsson et al; 1988, pp. 121-123.
High Voltage Cables in a New Class of Generators Powerformer; M. Leijon et al; Jun. 14, 1999; pp1-8.
Ohne Transformator direkt ins Netz; Owman et al, ABB, AB; Feb. 8, 1999, pp48-51.
Submersible Motors and Wet-Rotor Motors for Centrifugal Pumps Submerged in the Fluid Handled; K.. Bienick, KSB; Feb. 25, 1988; pp9-17.
High Voltage Generators; G. Beschastnov et al; 1977; vol. 48. No. 6 pp1-7.
Eine neue Type von Unterwassemotoren; Electrotechnik und Maschinenbam, 49; Aug. 1931; pp2-3.
Problems in design of the 110-5OokV high-voltage generators; Nikiti et al; World Electrotechnical Congress; Jun. 21-27, 1977; Section 1. Paper #18.
Manufacture and Testing of Roebel bars; P. Marti et al; 1960, Pub.86, vol. 8, pp. 25-31.
Hydroaltermators of 110 to 220kV Elektrotechn. Obz., vol. 64, No. 3, ppl32-136 Mar. 1975; A. Abramov.
Design Concepts for an Amorphous Metal Distribution Transformer; E. Boyd et al; IEEE Nov. 1984.
Neue Wege zum Bau zweipoliger Turbogeneratoren bis 2 GVA, 6OkV Elektrotechnik und Maschinenbau Wien Janner 1972, Heft 1, Seite 1-11; G. Aichholzer.
Optimizing designs of water-resistant magnet wire; V. Kuzenev et al; Elektrotekhnika, vol. 59, No. 12, pp35-40, 1988.
Zur Entwicklung der Tauchpumpenmotoren; A. Schanz; KSB, pp19-24.
Direct Generation of alternating current at high voltages; R. Parsons; IEEE Journal, vol. 67 #393, Jan. 15, 1929; pp1065-1080.
Stopfbachslose Umwalzpumpen- ein wichtiges Element im modernen Kraftwerkbau; H. Holz, KSB 1, pp13-19, 1960.
Zur Geschichte der Brown Boveri-Synchron-Maschinen; Vierzig Jahre Generatorbau; Jan.-Feb. 1931 pp15-39.
Technik und Anwendung moderner Tauchpumpen; A. Heumann; 1987.
High capacity syncronous generator having no tooth stator; V.S. Kildishev et al; No.1,1977 pp11-16.
Der Asyncromotor als Antrieb stopfbcichsloser Pumpen; E. Pismaus, Elektrotechnik und Maschinenbay No. 78; pp153-155, 1961.
Low core loss rotating flux transformer; R. F. Krause, et al; American Institute Physics J.Appl.Phys vol. 64 #10 Oct. 1988, pp5376-5378.
An EHV bulk Power transmission line Made with Low Loss XLPE Cable;Ichihara et al; Aug. 1992; pp3-6.
Underground Transmission Systems Reference Book; 1992; pp16-19; pp36-45; pp67-81.
Power System Stability and Control; P. Kundur, 1994; pp23-25;p. 767.
Six phase Synchronous Machine with AC and DC Stator Connections, Part II:Harmonic Studies and a proposed Uninterruptible Power Supply Scheme; R. Schiferl et al.; Aug. 1983 pp. 2694-2701.
Six phase Synchronous Machine with AC and DC Stator Connections, Part 1: Equivalent circuit repsentation and Steady-State Analysis; R. Schiferl et al; Aug. 1983; pp2685-2693.
Reactive Power Cmpensation; T. Petersson; 1993; pp. 1-23.
Permanent Magnet Machines; K. Binns; 1987; pp. 9-1 through 9-26.
Hochspannungsaniagen for Wechselstrom; 97. Hochspannungsaufgaben an Generatoren und Motoren; Roth et al; 1938; pp452-455.
Hochspannungsanlagen for Wechselstrom; 97. Hochspannungsaufgaben an Generatoren und Motoren; Roth et al; Spring 1959, pp30-33.
Neue Lbsungswege zum Entwurf grosser Turbogeneratoren bis 2GVA, 6OkV; G. Aicholzer; Sep. 1974, pp249-255.
Advanced Turbine-generators- an assessment; A. Appleton, et al; International Conf. Proceedings, Lg HV Elec. Sys. Paris, FR, Aug.-Sep. 1976, vol. I, Section 11-02, pg1-9.
Fully slotless turbogenerators; E. Spooner; Proc., IEEE vol. 120 #12, Dec. 1973.
Toroidal winding geometry for high voltage superconducting alternators; J. Kirtley et al; MIT—Elec. Power Sys. Engrg. Lab for IEEE PES;Feb. 1974.
High-Voltage Stator Winding Development; D. Albright et al; Proj. Report EL339, Project 1716, Apr. 1984.
POWERFORMER ™: A giant step in power plant engineering; Owman et al; CIGRE 1998, Paper 11:1.1.
Thin Type DC/DC Converter using a coreless wire transformer; K. Onda et al; Proc. IEEE Power Electronics Spec. Conf.; Jun. 1994, pp330-334.
Development of extruded polymer insulated superconducting cable; Jan. 1992.
Transformer core losses; B. Richardson; Proc. IEEE May 1986, pp365-368.
Cloth-transformer with divided windings and tension annealed amorphous wire; T. Yammamoto et al; IEEE Translation Journal on Magnetics in Japan vol. 4, No. 9 Sep. 1989.
A study of equipment sizes and constraints for a unified power flow controller; J Bian et al; IEEE 1996.
A test installation of a self-tuned ac filter in the Konti-Skan 2 HVDC link; T. Holmgren,G. Asplund, S. Valdemarsson, P. Hidman of ABB; U. Jonsson of Svenska Kraftnat; O. loof of Vattenfall Vastsverige AB; IEEE Stockholm Power Tech Conference Jun. 1995, pp 64-70.
Analysis of faulted Power Systems; P Anderson, Iowa State University Press / Ames, Iowa, 1973, pp 255-257.
36-Kv. Generators Arise from Insulation Research; P. Sidler; *Electrical World* Oct. 15, 1932, ppp 524.

Oil Water cooled 300 MW turbine generator;L.P. Gnedin et al;*Elektrotechnika*, 1970, pp 6-8.
J&P Transformer Book 11th Edition;A. C. Franklin et al; owned by Butterworth-Heinemann Ltd, Oxford Printed by Hartnolls Ltd in Great Britain 1983, pp29-67.
Transformerboard; H.P. Moser et al; 1979, pp 1-19.
The Skagerrak transmission—the world's longest HVDC submarine cable link; L. Haglof et al of ASEA; ASEA Journal vol. 53, No. 1-2, 1980, pp 3-12.
Direct Connection of Generators to HVDC Converters: Main Characteristics and Comparative Advantages; J.Arrillaga et al; *Electra* No. 149, Aug. 1993, pp 19-37.
Our flexible friend article; M. Judge; *New Scientist*, May 10, 1997, pp 44-48.
In-Service Performance of HVDC Converter transformers and oil-cooled smoothing reactors; G.L. Desilets et al; *Electra* No. 155, Aug. 1994, pp 7-29.
Transformateurs a courant continu haute tension-examen des specifications; A. Lindroth et al; *Electra* No 141, Apr. 1992, pp 34-39.
Development of a Termination for the 77 kV-Class High Tc Superconducting Power Cable; T. Shimonosono et al; IEEE Power Delivery, vol. 12, No 1, Jan. 1997, pp 33-38.
Verification of Limiter Performance in Modern Excitation Control Systems; G. K. Girgis et al; IEEE Energy Conservation, vol. 10, No. 3, Sep. 1995, pp 538-542.
A High Initial response Brushless Excitation System; T. L. Dillman et al; IEEE Power Generation Winter Meeting Proceedings, Jan. 31, 1971, pp 2089-2094.
Design, manufacturing and cold test of a superconducting coil and its cryostat for SMES applications; A. Bautista et al; IEEE Applied Superconductivity, vol. 7, No. 2, Jun. 1997, pp 840-843.
Quench Protection and Stagnant Normal Zones in a Large Cryostable SMES; Y. Lvovsky et al; IEEE Applied Superconductivity, vol. 7, No.2, Jun. 1997, pp. 857-860.
Design and Construction of the 4 Tesla Background Coil for the Navy SMES Cable Test Apparatus; D.W.Scherbarth et al; IEEE Appliel Superconductivity, vol. 7, No. 2, Jun. 1997, pp. 840-843.
High Speed Synchronous Motors Adjustable Speed Drives; ASEA Generation Pamphlet OG 135-101 E, Jan. 1985, pp 1-4.
Bilig burk motar overtoned; A. Felldin; *Era* (Teknik) Aug. 1994, pp 26-28.
400-kV XLPE cable system passes CIGRE test; ABB Article; ABB Review Sep. 1995, pp 38.
FREQSYN—a new drive system for high power applications;J-A. Bergman et al; ASEA Journal 59, Apr. 1986, pp16-19.
Canadians Create Conductive Concrete; J. Beaudoin et al; *Science*, vol. 276, May 23, 1997, pp 1201.
Fully Water-Cooled 190 MVA Generators in the Tonstad Hydroelectric Power Station; E. Ostby et al; BBC Review Aug. 1969, pp 380-385.
Relocatable static var compensators help control unbundled power flows; R. C. Knight et al; *Transmission & Distribution*, Dec. 1996, pp 49-54.
Investigation and Use of Asynchronized Machines in Power Systems*; N.I.Blotskii et al; *Elektrichestvo*, No. 12, 1-6, 1985, pp 90-99.
Variable-speed switched reluctance motors; P.J. Lawrenson et al; IEE proc, vol. 127, Pt.B, No. 4, Jul. 1980, pp 253-265.
Das Einphasenwechselstromsystem hoherer Frequenz; J.G. Hetf, Elektrische Bahnen eb; Dec. 1987, pp 388-389.
Power Transmission by Direct Current;E. Uhlmann;ISBN 3-540-07122-9 Springer-Verlag, Berlin/Heidelberg/New York; 1975, pp 327-328.
Elektriska Maskiner; F. Gustavson; Institute Elkreafteknilk, KTH; Stockholm, 1996, pp 3-6-3-12.
Die Wechselstromtechnik; A. Cour' Springer Verlag, Germany; 1936, pp 586-598.
Insulation systems for superconducting transmission cables; O. Toennesen; Nordic Insulation Symposium, Bergen, 1996, pp 425-432.
MPTC: An economical alternative to universal power flow controllers;N. Mohan; EPE 1997, Trondheim, pp 3.1027-3.1030.
Lexikon der Technik; Luger; Band 2, Grundlagen der Elektrotechnik und Kerntechnik, 1960, pp 395.
Das Handbuch der Lokomotiven ( hungarian locomotive V40 1'D'); B. Hollingsworth et al; Pawlak Verlagsgesellschaft; 1933, pp. 245-255.
Synchronous machines with single or double 3-phase star-connected winding fed by 12-pulse load commulated inverter. Simulation of operational behaviour; C. Ivarson et al; ICEM 1994, International Conference on electrical machines, vol. 1, pp 267-272.
Elkrafthandboken, Elmaskiner; A. Rejminger; Elkrafthandboken, Elmaskiner 1996, 15-20.
Power Electronics- in Theory and Practice; K. Thorborg; ISBN 0-86238-341-2, 1993, pp 1-13.
Regulating transformers in power system-new concepts and applications; E. Wirth et al; ABB Review Apr. 1997, p 12-20.
Transforming transformers; S. Mehta et al; *IEEE Spectrum*, Jul. 1997, pp. 43-49.
A study of equipment sizes and constraints for a unified power flow controller; J. Bian et al; IEEE Transactions on Power Delivery, vol. 12, No. 3, Jul. 1997, pp. 1385-1391.
Industrial High Voltage; F.H. Kreuger; *Industrial High Voltage* 1991 vol. 1, pp. 113-117.
Hochspannungstechnik; A. Küchler; Hochspannungstechnik, VDI Verlag 1996, pp. 365-366, ISBN 3-18-401530-0 or 3-540-62070-2.
High Voltage Engineering; N.S. Naidu; High Voltage Engineering, second edition 1995 ISBN 0-07-462286-2, Chapter 5, pp91-98.
Performance Characteristics of a Wide Range Induction Type Frequency Converter; G.A. Ghoneem; Ieema Journal, Sep. 1995, pp 21-34.
International Electrotechnical Vocabulary, Chapter 551 Power Electronics;unknown author; International Electrotechnical Vocabulary Chapter 551: Power Electronics Bureau Central de la Commission Electrotechnique Internationale, Geneve; 1982, pp1-65.
Design and manufacture of a large superconducting homopolar motor; A.D. Appleton; IEEE Transactions on Magnetics, vol. 19,No. 3, Part 2, May 1983, pp 1048-1050.
Application of high temperature of a large superconductivy to electric motor design; J.S. Edmonds et al; IEEE Transactions on Energy Conversion Jun. 1992, No. 2, pp 322-329.
Power Electronics and Variable Frequency Drives; B. Bimal; IEEE industrial Electronics-Technology and Applications, 1996, pp. 356.

Properties of High Plymer Cement Mortar; M. Tamai et al; *Science & Technology in Japan, No 63* ; 1997, pp 6-14.
Weatherability of Polymer-Modified Mortars after Ten-Year Outdoor Exposure in Koriyama and Sapporo; Y. Ohama et al; *Science & Technology in Japan No. 63*; 1977, pp 26-31.
SMC Powders Open New Magnetic Applications; M. Persson (Editor); *SMC Update*, Vol. 1, No. 1, Apr. 1997.
Characteristics of a laser triggered spark gap using air, Ar, CH4,H2, He, N2, SF6 and Xe; W.D. Kimura et al; Journal of Applied Physics, vol. 63, No 6, Mar. 15, 1988, p. 1882-1888.
Low-intensy laser-triggering of rail-gaps with magnesium-aerosol switching-gases; W. Frey; 11th International Pulse Power Conference, 1997, Baltimore, USA Digest of Technical Papers, p. 322-327.
U.S. Appl. No. 09/541,523, pending.

* cited by examiner

Fig. 5 a
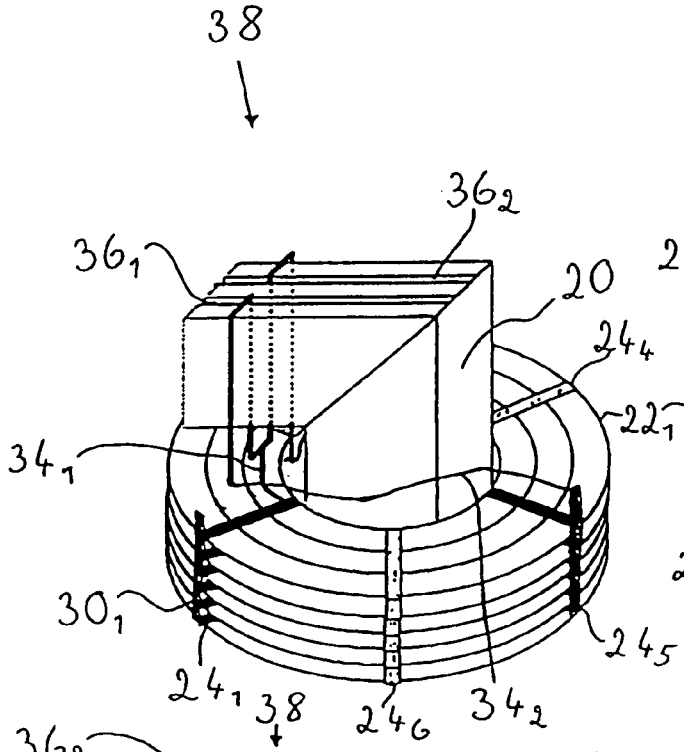
Fig. 5 b
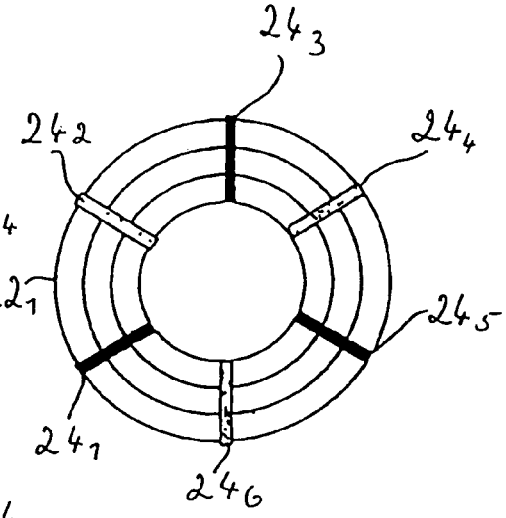
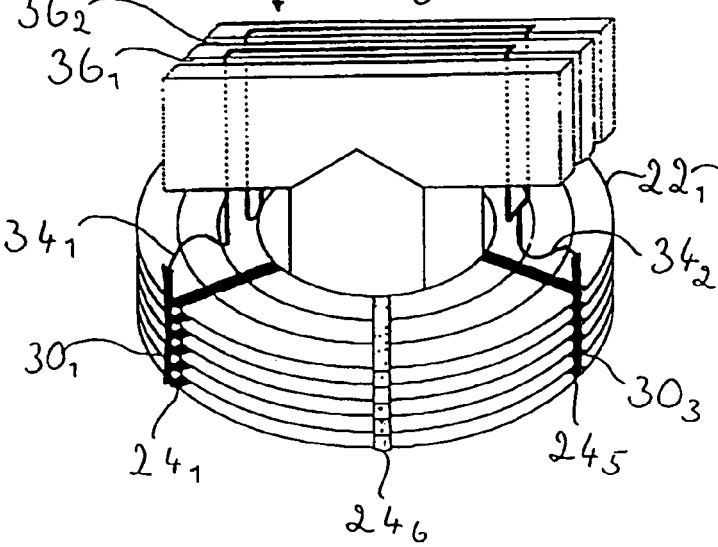
Fig. 6 a
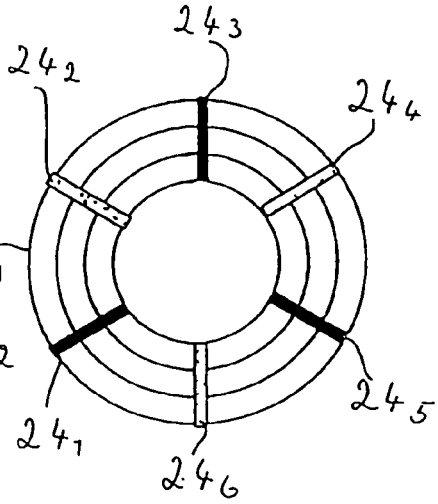
Fig. 6 b

POWER TRANSFORMER/INDUCTOR

BACKGROUND OF THE INVENTION

1. Field of the Invention

The present invention relates to a power transformer/inductor. In all transmission and distribution of electric energy, transformers are used for enabling exchange between two or more electric systems normally having different voltage levels. Transformers are available for powers from the VA region to the 1000 MVA region. The voltage range has a spectrum of up to the highest transmission voltages used today. Electro-magnetic induction is used for energy transmission between electric systems.

Inductors are also an essential component in the transmission of electric energy in for example phase compensation and filtering.

The transformer/inductor related to the present invention belongs to the so-called power transformers/inductors having rated outputs from several hundred kVA to in excess of 1000 MVA and rated voltages of from 3–4 kV to very high transmission voltages.

2. Discussion of the Background

In general the main task of a power transformer is to enable the exchange of electric energy, between two or more electric systems of mostly differing voltages with the same frequency.

Conventional power transformers/inductors are e.g. described in the book "Elektriska Maskiner" by Fredrik Gustavson, page 3-6–3-12, published by The Royal Institute of Technology, Sweden, 1996.

A conventional power transformer/inductor includes a transformer core, referred to below as "core", formed of laminated commonly oriented sheet, normally of silicon iron. The core is composed of a number of core legs connected by yokes. A number of windings are provided around the core legs normally referred to as primary, secondary and regulating winding. In power transformers these windings are practically always arranged in concentric configuration and distributed along the length of the core leg.

Other types of core structures occasionally occur in e.g. so-called shell transformers or in ring-core transformers. Examples related to core transformers are discussed in DE 40414. The core may be made of conventional magnetizable materials such as the oriented sheet and other magnetizable materials such as ferrites, amorphous material, wire strands or metal tape. The magnetizable core is, as known, not necessary in inductors.

The above-mentioned windings constitute one or several coils connected in series, the coils of which having a number of turns connected in series. The turns of a single coil normally make up a geometric, continuous unit which is physically separated from the remaining coils.

A conductor is known through U.S. Pat. No. 5,036,165, in which the insulation is provided with an inner and an outer layer of semiconducting pyrolized glassfiber. It is also known to provide conductors in a dynamo-electric machine with such an insulation, as described in U.S. Pat. No. 5,066,881 for instance, where a semiconducting pyrolized glassfiber layer is in contact with the two parallel rods forming the conductor, and the insulation in the stator slots is surrounded by an outer layer of semiconducting pyrolized glassfiber. The pyrolized glassfiber material is described as suitable since it retains its resistivity even after the impregnation treatment.

The insulation system on the inside of a coil/winding and between coils/windings and remaining metal parts, is normally in the form of a solid- or varnish based insulation closest to the conducting element and on the outside thereof the insulation system is in the form of a solid cellulose insulation, a fluid insulation, and possibly also an insulation in the form of gas. Windings with insulation and possible bulky parts represent in this way large volumes that will be subjected to high electric field strengths occurring in and around the active electric magnetic parts belonging to transformers. A detailed knowledge of the properties of insulation material is required in order to predetermine the dielectric field strengths which arise and to attain a dimensioning such that there is a minimal risk of electrical discharge. It is important to achieve a surrounding environment which does not change or reduce the insulation proper ties.

Today's predominant outer insulation system for conventional high voltage power transformers/inductors are made of cellulose material as the solid insulation and transformer oil as the fluid insulation. Transformer oil is based on so-called mineral oil.

Conventional insulation systems are e.g. described in the book "Elektriska Maskiner" by Fredrik Gustavson, page 3-9–3-11, published by The Royal Institute of Technology, Sweden, 1996.

Conventional insulation systems are relatively complicated to construct and additionally, special measures need to be taken during manufacture in order to utilize good insulation properties of the insulation system. The system must have a low moisture content and the solid phase in the insulation system needs to be well impregnated with the surrounding oil so that there is minimal risk of gas pockets. During manufacture a special drying process is carried out on the complete core with windings before it is lowered into the tank. After lowering the core and sealing the tank, the tank is emptied of all air by a special vacuum treatment before being filled with oil. This process is relatively time-consuming seen from the entire manufacturing process in addition to the extensive utilization of resources in the workshop.

The tank surrounding the transformer must be constructed in such a way that it is able to withstand full vacuum since the process requires that all the gas be pumped out to almost absolute vacuum which involves extra material consumption and manufacturing time.

Furthermore the installation requires vacuum treatment to be repeated each time the transformer is opened for inspection.

SUMMARY OF THE INVENTION

According to the present invention the power transformer/inductor includes at least one winding in most cases arranged around a magnetizable core which may be of different geometries. The term "windings" will be referred to below in order to simplify the following specification. The windings are composed of a high voltage cable with solid insulation. The cables have at least one centrally situated electric conductor. Around the conductor there is arranged a first semi-conducting layer, around the semi-conducting layer there is arranged a solid insulating layer and around the solid insulating layer there is arranged a second external semi-conducting layer.

The use of such a cable implies that those regions of a transformer/inductor which are subjected to high electric stress are confined to the solid insulation of the cable. Remaining parts of the transformer/inductor, with respect to high voltage, are only subjected to very moderate electric field strengths. Furthermore, the use of such a cable eliminates several problem areas described under the background of the invention. Consequently a tank is not needed for insulation and coolant. The insulation as a whole also becomes substantially simple. The time of construction is considerably shorter compared to that of a conventional power transformer/inductor. The windings may be manufactured separately and the power transformer/inductor may be assembled on site.

However, the use of such a cable presents new problems which must be solved. The second semi-conducting layer must be directly earthed in or in the vicinity of both ends of the cable so that the electric stress which arises, both during normal operating voltage and during transient progress, will primarily load only the solid insulation of the cable. The semi-conducting layer and these direct earthings form together a closed circuit in which a current is induced during operation. The resistivity of the layer must be high enough so that resistive losses arising in the layer are negligible.

Besides this magnetic induced current, a capacitive current is to flow into the layer through both directly earthed ends of the cable. If the resistivity of the layer is too great, the capacitive current will become so limited that the potential in parts of the layer, during a period of alternating stress, may differ to such an extent from earth potential that regions of the power transformer/inductor other than the solid insulation of the windings will be subjected to electric stress. By directly earthing several points of the semiconducting layer, preferably one point per turn of the winding, the whole outer layer resting at earth potential and the elimination of the above-mentioned problems is ensured if the conductivity of the layer is high enough.

This one point earthing per turn of the outer layer is performed in such a way that the earth points rest on a generatrix to a winding and that points along the axial length of the winding are electrically directly connected to a conducting earth track which is connected thereafter to the common earth potential.

In order to keep the losses in the outer layer as low as possible, it may be desirable to have such a high resistivity in the outer layer that several earth points per turn are required. This is possible according to a special earthing process in accordance with the invention.

Thus, in a power transformer/inductor according to the invention the second semiconducting layer is earthed at or in the vicinity of both ends of each winding and furthermore one point between both ends is directly earthed.

In a power transformer/inductor according to the invention the windings are preferably composed of cables having solid, extruded insulation, of a type now used for power distribution, such as XLPE-cables or cables with EPR-insulation. Such cables are flexible, which is an important property in this context since the technology for the device according to the invention is based primarily on winding systems in which the winding is formed from cable which is bent during assembly. The flexibility of a XLPE-cable normally corresponds to a radius of curvature of approximately 20 cm for a cable 30 mm in diameter, and a radius of curvature of approximately 65 cm for a cable 80 mm in diameter. In the present application the term "flexible" is used to indicate that the winding is flexible down to a radius of curvature in the order of four times the cable diameter, preferably eight to twelve times the cable diameter.

Windings in the present invention are constructed to retain their properties even when they are bent and when they are subjected to thermal stress during operation. It is vital that the layers of the cable retain their adhesion to each other in this context. The material properties of the layers are decisive here, particularly their elasticity and relative coefficients of thermal expansion. In a XPE-cable, for instance, the insulating layer is made of cross-linked, low-density polyethylene, and the semiconducting layers are made of polyethylene with soot and metal particles mixed in. Changes in volume as a result of temperature fluctuations are completely absorbed as changes in radius in the cable and, thanks to the comparatively slight difference between the coefficients of thermal expansion in the layers in relation to the elasticity of these materials, the radial expansion can take place without the adhesion between the layers being lost.

The material combinations stated above should be considered only as examples. Other combinations fulfilling the conditions specified and also the condition of being semiconducting, i.e. having resistivity within the range of $10^{-1}$–$10^{6}$ ohm-cm, e.g. 1–500 ohm-cm, or 10–200 ohm-cm, naturally also fall within the scope of the invention.

The insulating layer may be made, for example, of a solid 5 thermoplastic material such as low-density polyethylene (LDPE), high-density polyethylene (HDPE), polypropylene (PP), polybutylene (PB), polymethyl pentene (PMP), crosslinked materials such as cross-linked polyethylene (XLPE), or rubber such as ethylene propylene rubber (EPR) or silicon rubber.

The inner and outer semiconducting layers may be of the same basic material but with particles of conducting material such as soot or metal powder mixed in.

The mechanical properties of these materials, particularly their coefficients of thermal expansion, are affected relatively little by whether soot or metal powder is mixed in or not-at least in the proportions required to achieve the conductivity necessary according to the invention. The insulating layer and the semiconducting layers thus have substantially the same coefficients of thermal expansion.

Ethylene-vinyl-acetate copolymers/nitrile rubber, butyl graft polyethylene, ethylene-butyl-acrylate-copolymers and ethylene-ethyl-acrylate copolymers may also constitute suitable polymers for the semiconducting layers.

Even when different types of material are used as a base in the various layers, it is desirable for their coefficients of thermal expansion to be substantially the same. This is the case with combination of the materials listed above.

The materials listed above have relatively good elasticity, with an E-modulus of E<500 MPa, preferably <200 MPa. The elasticity is sufficient for any minor differences between the coefficients of thermal expansion for the materials in the layers to be absorbed in the radial direction of the elasticity so that no cracks or other damage appear and so that the layers are not released from each other. The material in the layers is elastic, and the adhesion between the layers is at least of the same magnitude as the weakest of the materials.

The conductivity of the two semiconducting layers is sufficient to substantially equalize the potential along each layer. The conductivity of the outer semiconducting layer is sufficiently large to contain the electrical field in the cable, but sufficiently small not to give rise to significant losses due to currents induced in the longitudinal direction of the layer.

Thus, each of the two semiconducting layers essentially constitutes one equipotential surface, and these layers will substantially enclose the electrical field between them.

There is, of course, nothing to prevent one or more additional semiconducting layers being arranged in the insulating layer.

The invention will now be described in more detail in the following description of preferred embodiments with reference to the accompanying drawings.

BRIEF DESCRIPTION OF THE DRAWINGS

FIGS. 5*a* and 5*b* respectively, show a perspective view and a side view respectively of a winding, on an outer leg of a three phase transformer with three legs, with three earthing points per winding turn according to a third embodiment of the present invention; and FIGS. 6*a* and 6*b* respectively, show a perspective view and a side view respectively of a winding, on a central leg of a three phase transformer with three or more legs, with three earthing points per winding turn according to a fourth embodiment of the present invention.

DETAILED DESCRIPTION OF THE PREFERRED EMBODIMENTS

Figure 1:
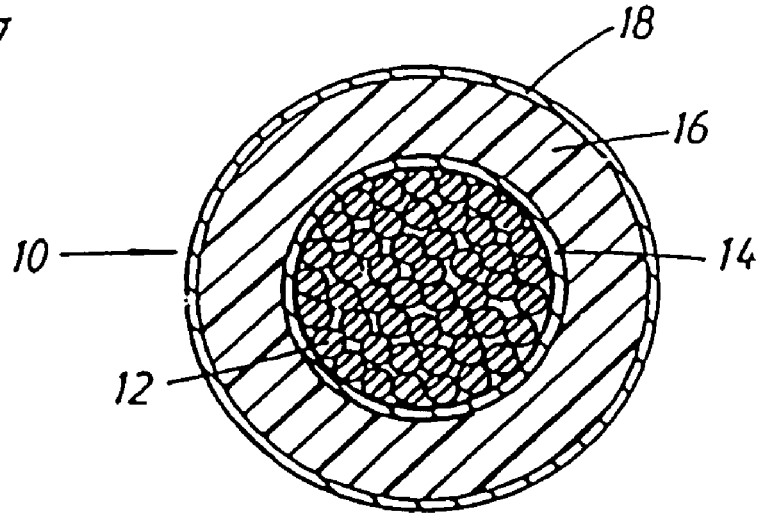
FIG. 1 shows a cross-sectional view of a high-voltage cable.

FIG. 1 shows a cross-sectional view of a high voltage cable which is used traditionally for the transmission of electric energy. The shown high voltage cable may for example be a standard XLPE cable 145 kV but without mantle and screen. The high voltage cable 10 includes an electric conductor, which may have one or several strands 12 with circular cross-section of for example copper (Cu). These strands 12 are arranged in the center of the high voltage cable 10. Around the strands 12 there is arranged a first semi conducting layer 14. Around the first semi conducting layer 14 there is arranged a first insulating layer 16, for example XLPE insulation. Around the first insulating 16 there is arranged a second semi conducting layer 18. The high voltage cable 10, shown in FIG. 1, is built with a conductor area of between 80 and 3000 $mm_2$ and an outer cable diameter of between 20 and 250 mm.

Figure 2:
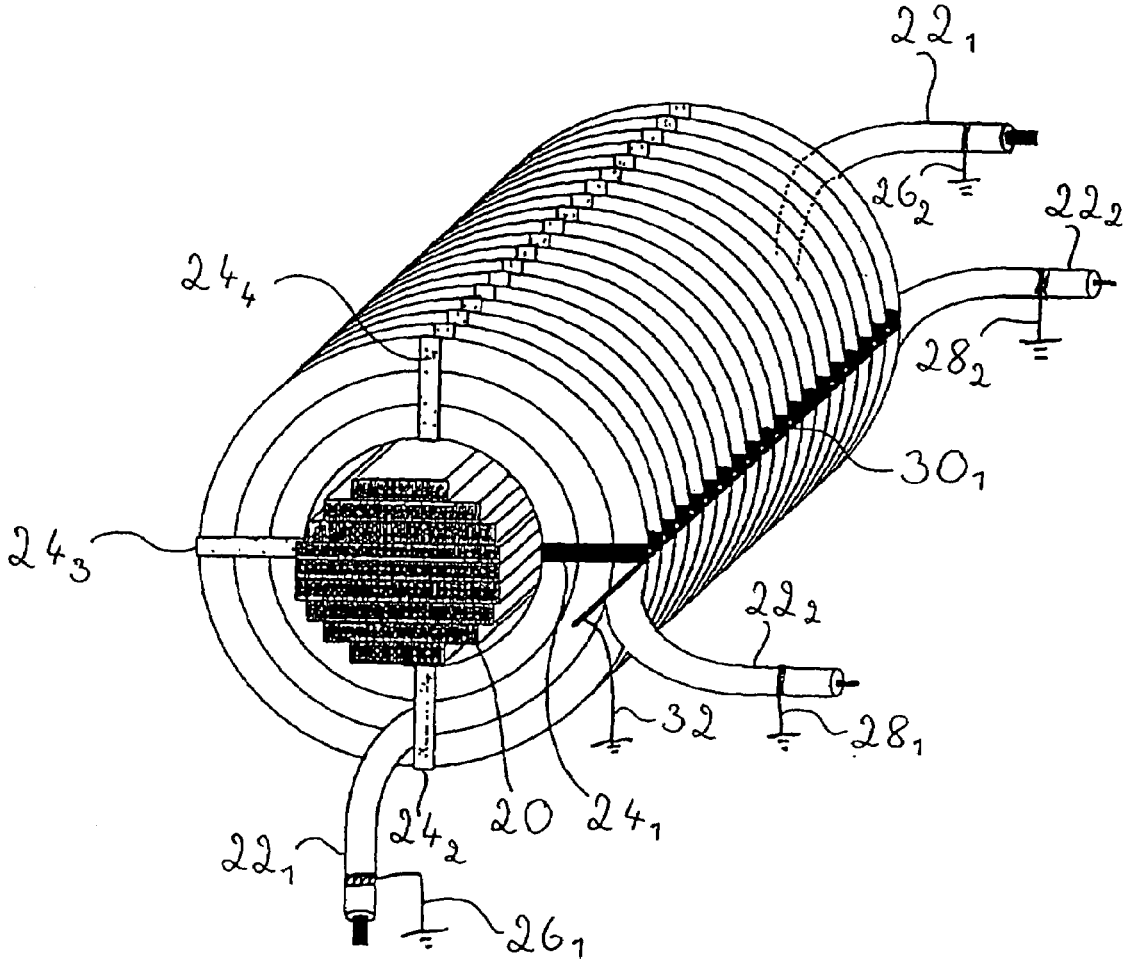
FIG. 2 shows a perspective view of windings with one earthing point per winding turn.

FIG. 2 shows a perspective view of windings with one earthing point per winding turn. FIG. 2 shows a core leg designated by the numeral 20 within a power transformer or inductor. Two windings $\mathbf{22}_1$ and $\mathbf{22}_2$ are arranged around the core leg 20 which are formed from the high-voltage cable (10) shown in FIG. 1. With the aim of fixing windings $\mathbf{22}_1$ and $\mathbf{22}_2$ there are, in this case, four radially arranged spacer members $\mathbf{24}_1$, $\mathbf{24}_2$, $\mathbf{24}_3$, $\mathbf{24}_4$ per winding turn. As shown in FIG. 2 the outer semi conducting layer is earthed at both ends $\mathbf{26}_1$, $\mathbf{26}_2$, $\mathbf{28}_1$, $\mathbf{28}_2$ of each winding $\mathbf{22}_1$, $\mathbf{22}_2$. Spacer member $\mathbf{24}_1$, which is emphasized in black, is utilized to achieve one earthing point per winding turn. The spacer member $\mathbf{24}_1$ is directly connected to one earthing element $\mathbf{30}_1$, i.e. in the form of an earthing track $\mathbf{30}_1$, which is connected 32 to the common earth potential at the periphery of the winding $\mathbf{22}_2$ and along the axial length of the winding $\mathbf{22}_2$. As shown in FIG. 2 the earthing points rest (one point per winding turn) on a generatrix to a winding.

Figure 3:
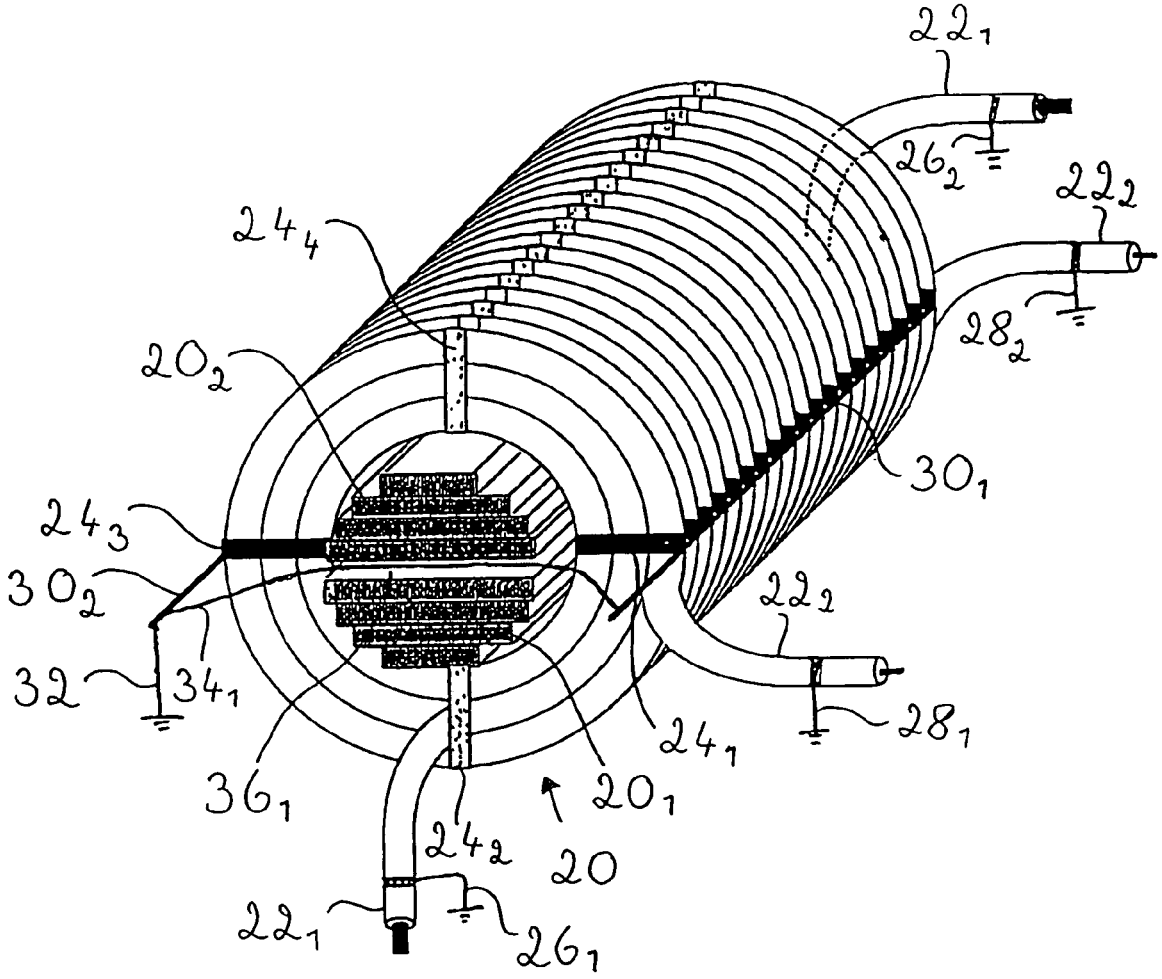
FIG. 3 shows a perspective view of windings with two earthing points per winding turn according to a first embodiment of the present invention.

FIG. 3 shows a perspective view of windings with two earthing points per winding turn according to a first embodiment of the present invention. In FIGS. 2 and 3 the same parts are designated by the same numerals in order to make the Figures more clear. Also in this case the two windings $\mathbf{22}_1$ and $\mathbf{22}_2$, formed from the high-voltage cable 10 shown in FIG. 1, are arranged around the core leg 20. Spacer member $\mathbf{24}_1$, $\mathbf{24}_2$, $\mathbf{24}_3$, $\mathbf{24}_4$ are also in this case radially arranged with the aim of fixing the windings $\mathbf{22}_1$ and $\mathbf{22}_2$. At both ends $\mathbf{26}_1$, $\mathbf{26}_2$, $\mathbf{28}_1$, $\mathbf{28}_2$ of each winding $\mathbf{22}_1$ and $\mathbf{22}_2$ the second semiconducting layer (compare with FIG. 1) is earthed in accordance with FIG. 2. Spacer members $\mathbf{24}_1$, $\mathbf{24}_3$, which are marked in black, are used in order to achieve two earthing points per winding turn. Spacer member $\mathbf{24}_1$ is directly connected to a first earthing element $\mathbf{30}_1$ and spacer member $\mathbf{24}_3$ is directly connected to a second earthing element $\mathbf{30}_2$ at the periphery of the winding $\mathbf{22}_2$ and along the axial length of the winding $\mathbf{22}_2$. Earthing elements $\mathbf{30}_1$ and $\mathbf{30}_2$ may be in the form of earthing tracks $\mathbf{30}_1$ and $\mathbf{30}_2$ which are connected to the common earth potential 32. Both earthing elements $\mathbf{30}_1$, $\mathbf{30}_2$ are coupled by way of an electric connection $\mathbf{34}_1$ (cable). The electric connection $\mathbf{34}_1$ is drawn into one slot $\mathbf{36}_1$ arranged in the core leg 20. The slot 36 is arranged such that the cross-section area A1 of the core leg 20 (and thereby the magnetic flow Φ) is divided into two partial areas A1, A2. Accordingly, the slot 361 divides the 20 core leg 20 into two parts, $\mathbf{20}_1$, $\mathbf{20}_2$. This entails that currents are not magnetically induced in connection with earthing tracks. By earthing in the above-mentioned way the losses in the second semiconducting layer are kept to a minimum.

Figure 4:
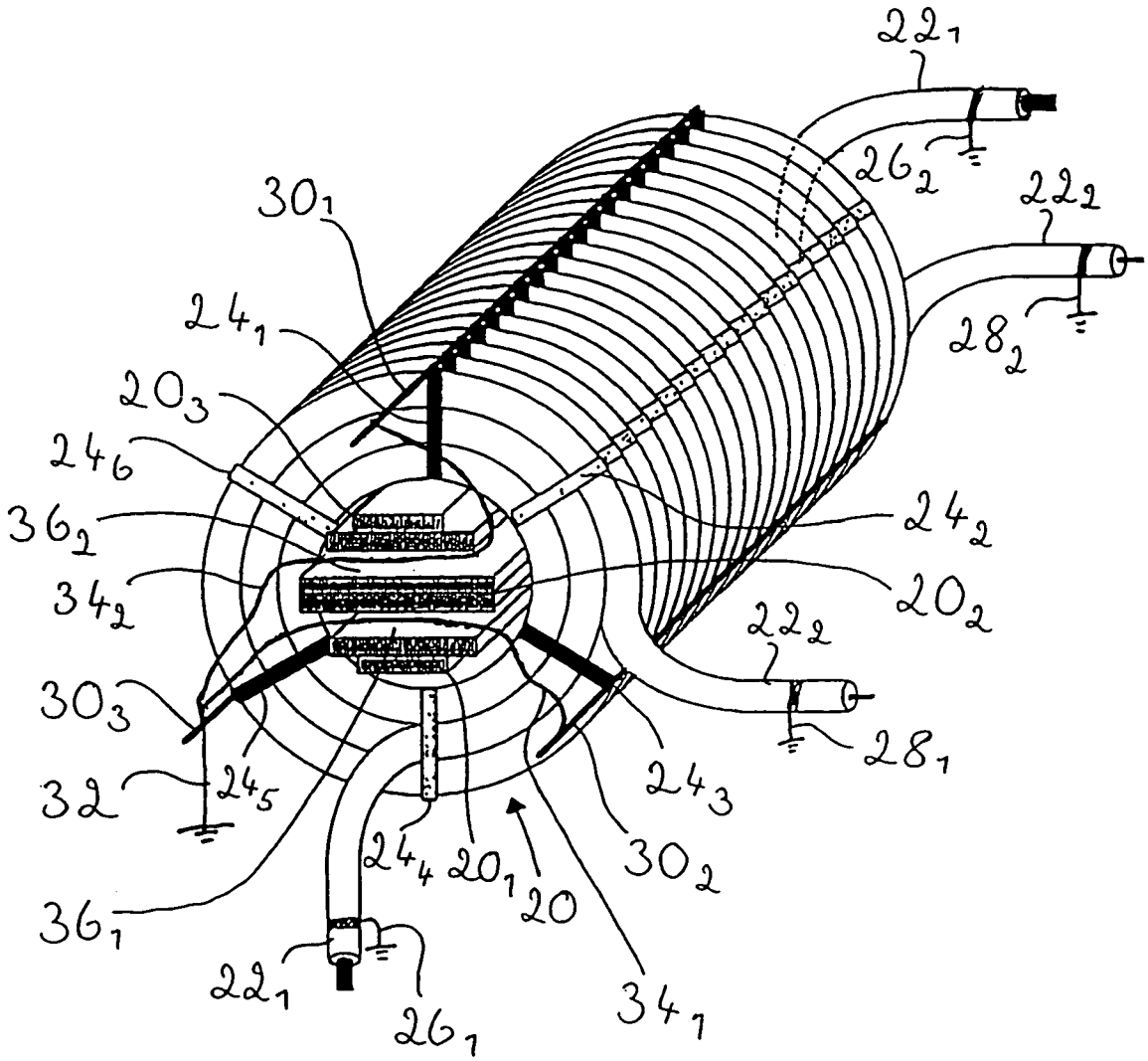
FIG. 4 shows a perspective view of windings with three earthing points per winding turn according to a second embodiment of the present invention.

FIG. 4 shows a perspective view of windings with three earthing points per winding turn according to a second embodiment of the present invention. In FIGS. 2–4 the same parts are designated by the same numerals in order to make the Figures more clear. Also here two windings $\mathbf{22}_1$ and $\mathbf{22}_2$, formed from the high-voltage cable 10 shown in FIG. 1, are arranged around the core leg 20. Spacer members $\mathbf{24}_1$, $\mathbf{24}_2$, $\mathbf{24}_3$, $\mathbf{24}_4$, $\mathbf{24}_5$, $\mathbf{24}_6$, are also radially arranged with the aim of fixing windings $\mathbf{22}_1$ and $\mathbf{22}_2$. As shown in FIG. 4 there are 6 spacer members per winding turn. At both ends $\mathbf{26}_1$, $\mathbf{26}_2$; $\mathbf{28}_1$, $\mathbf{28}_2$ of each winding $\mathbf{22}_1$, $\mathbf{22}_2$ the outer semiconducting layer (compare with FIG. 1) is earthed as in accordance with FIGS. 2 and 3. Spacer members $\mathbf{24}_1$, $\mathbf{24}_3$, $\mathbf{24}_5$ which are marked in black are used to achieve three earthing points per winding turn. These spacer members $\mathbf{24}_1$, $\mathbf{24}_3$, $\mathbf{24}_5$ are accordingly connected to the second semiconducting layer of the high power cable 10. Spacer member $\mathbf{24}_1$ is directly connected to a first earthing element $\mathbf{30}_1$ and spacer member $\mathbf{24}_3$ is directly connected to a second earthing element $\mathbf{30}_2$ and spacer member $\mathbf{24}_5$ is directly connected to a third earthing element $\mathbf{30}_3$ at the periphery of the winding $\mathbf{22}_2$ and along the axial length of the winding $\mathbf{22}_2$. Earthing elements $\mathbf{30}_1$, $\mathbf{30}_2$, $\mathbf{30}_3$, may be in the form of earthing tracks $\mathbf{30}_1$, $\mathbf{30}_2$, $\mathbf{30}_3$ which are connected to the common earth potential 32. All three earthing elements $\mathbf{30}_1$, $\mathbf{30}_2$, $\mathbf{30}_3$ are joined by way of two electric connections $\mathbf{34}_1$, $\mathbf{34}_2$ (cables). The electric connection $\mathbf{34}_1$ is drawn into a first slot $\mathbf{36}_1$ arranged in the core leg 20 and is connected to earthing elements $\mathbf{30}_2$ and $\mathbf{30}_3$. The electric connection $\mathbf{34}_2$ is drawn into second slot $\mathbf{36}_2$ arranged in the core leg 20. Slots $\mathbf{36}_1$, $\mathbf{36}_2$ are arranged such that the cross-section area A, of the core leg 20 (and thereby the magnetic flow Φ) are divided into three partial areas $A_1$, $A_2$, $A_3$. Accordingly slots $\mathbf{36}_1$, $\mathbf{36}_2$ divide the core leg 20 into three parts $\mathbf{20}_1$, $\mathbf{20}_2$, $\mathbf{20}_3$. This entails that currents are not magnetically induced in connection with earthing tracks. By earthing in the above-mentioned way losses in the second semiconducting layer are kept to a minimum.

FIGS. 5*a* and 5*b* respectively, show a perspective view respectively and a sectional view of a winding on an outer leg of a three phase transformer with three legs with three earthing points per winding turn according to a third embodiment of the present invention. In FIGS. 2–5 the same parts are designated the same numerals in order to make the Figures more clear. A winding $\mathbf{22}_1$, formed from the high-voltage cable 10 shown in FIG. 1, is arranged around the outer leg 20 of the transformer. Additionally in this case spacer members $\mathbf{24}_1$, $\mathbf{24}_2$, $\mathbf{24}_3$, $\mathbf{24}_4$, $\mathbf{24}_5$, $\mathbf{25}_6$ are arranged radially with the aim of fixing the winding $\mathbf{22}_1$. At both ends of the winding $\mathbf{22}_2$ the second semiconducting layer (compare with FIG. 1) is earthed (not shown in FIGS. 5*a* and 5*b* respectively). Spacer members $\mathbf{24}_1$, $\mathbf{24}_3$, $\mathbf{24}_5$, which are marked in black, are used to achieve three earthing points per winding turn. Spacer member $\mathbf{24}_1$ is directly connected to a first earthing element $\mathbf{30}_1$, spacer member $\mathbf{24}_3$ is directly connected to a second earthing element (not shown) and spacer member $\mathbf{24}_5$ is directly connected to a third earthing element $\mathbf{30}_3$ at the periphery of the winding $\mathbf{22}_1$ and along the axial length of the winding $\mathbf{22}_1$. Earthing elements $\mathbf{30}_1$–$\mathbf{30}_3$ may be in the form of earthing tracks which are connected to the common earth potential (not shown). The three earthing elements $\mathbf{30}_1$–$\mathbf{30}_3$ are joined by way of two electric connections $\mathbf{34}_1$, $\mathbf{34}_2$ (cables). The two electric connections $\mathbf{34}_1$, $\mathbf{34}_2$ are drawn in two slots $\mathbf{36}_1$, $\mathbf{36}_2$, arranged in a yoke 38 connecting the three earthing elements $\mathbf{30}_1$–$\mathbf{30}_3$ to each other. The two slots $\mathbf{36}_1$, $\mathbf{36}_2$ are arranged such that the cross-section area A of the yoke 38, (and thereby the magnetic flux Φ) is divided into three partial areas $A_1$, $A_2$, $A_3$. The electric connections $\mathbf{34}_1$, $\mathbf{34}_2$ are threaded through the two slots $\mathbf{36}_1$, $\mathbf{36}_2$ and over the front and back side of the yoke 38. By earthing in the above-mentioned way the losses are kept to a minimum.

FIGS. 6*a* and 6*b* respectively, show a perspective view respectively and a sectional view of a winding, on a central leg of a three phase transformer with three or more legs, with three earthing points per winding turn according to a fourth embodiment of the present invention. In FIGS. 2–6 the same parts are designated the same numerals in order to make the Figures more clear. A winding $\mathbf{22}_1$, formed from the high voltage cable 10 shown in FIG. 1 is arranged around the central leg 20 of the transformer. Additionally in this case spacer members $\mathbf{24}_1$–$\mathbf{24}_6$ are arranged radially, three of which $\mathbf{24}_1$, $\mathbf{24}_3$, $\mathbf{24}_5$ are used to achieve three earthing points per winding turn. The spacer members $\mathbf{24}_1$, $\mathbf{24}_3$, $\mathbf{24}_5$ are directly connected to the earthing elements $\mathbf{30}_1$–$\mathbf{30}_3$, of which only two are shown, in the same way as described above in connection with FIGS. 5*a*, and 5*b*. The three earthing elements $\mathbf{30}_1$–$\mathbf{30}_3$ are connected by way of two electric connections $\mathbf{34}_1$, $\mathbf{34}_2$ (cables). The two electric connections $\mathbf{34}_1$, $\mathbf{34}_2$ are drawn into two slots $\mathbf{36}_1$, $\mathbf{36}_2$ arranged in a yoke 38. The two slots $\mathbf{36}_1$, $\mathbf{36}_2$ are arranged such that the cross section area A of the yoke 38 (and thereby the magnetic flux Φ) is divided into three partial areas $A_1$, $A_2$, $A_3$. The two electric connections $\mathbf{34}_1$, $\mathbf{34}_2$ are threaded through slots $\mathbf{36}_1$, $\mathbf{36}_2$ on both sides of the central leg 20 relative to the yoke 38. By earthing in the above-mentioned way the losses in the second semiconducting layer are kept to a minimum.

The principles used above may be used for several earthing points per winding turn. The magnetic flux, Φ, is located in the core with a cross-section area A. This cross-section area A can be divided into a number of partial areas $A_1, A_2, \ldots, A_n$ so that;

$$A = \sum_{i=1}^{n} A_i$$

The circumference of a winding turn with length 1 can be divided into a number of parts $\mathbf{1}_1, \mathbf{1}_2, \ldots, \mathbf{1}_n$ so that;

$$l = \sum_{i=1}^{n} l_i$$

No extra losses due to earthing are introduced if the electric connections are made in such a way that the ends of every part $\mathbf{1}_i$ are electrically connected so that only the partial area $A_i$ is encompassed by a coil having an electric connection $\mathbf{66}_i$ and the segment $\mathbf{1}_i$ and the condition, $$\frac{\phi_i}{\phi} = \frac{l_i}{l}$$

is fulfilled, whereby Φ is the magnetic flux in the core and $\Phi_i$ is the magnetic flux through the partial area $A_i$.

If the magnetic flux density is constant throughout the entire cross-section of the core, then Φ=B*A leads to the ratio;

$$\frac{A_1}{A} = \frac{l_i}{l}$$

The power transformer/inductor in the above shown figures includes an iron core made of a core leg and a yoke. It should however be understood that a power transformer/inductor may also be designed without an iron core (aircored transformer).

The invention is not limited to the shown embodiments since several variations are possible within the frame of the attached patent claims.

What is claimed is:

1. A power transformer/inductor comprising:

at least one winding of a high-voltage cable, said winding being formed as a winding turn of said power transducer/inductor, said high-voltage cable having layers and an electric conductor, said layers including:

a first semiconducting layer arranged around the conductor, an insulating layer arranged around the first semiconducting layer and a second semiconductor layer arranged around the insulating layer, the second semiconducting layer being earthed at or in the vicinity of both ends of each winding and a point between both ends being directly earthed.

2. A power transformer/inductor according to claim 1, wherein:

n points, where n is at least 2, per at least one turn of the at least one winding being directly earthed so that electric connections between the n points divide a magnetic flux in the at least one turn into n parts so as to limit losses produced by earthing.

3. A power transformer/inductor according to claim 2, wherein:

the high-voltage cable having a conductor area in an inclusive range of 80 through 3000 $mm^2$ and with an outer cable diameter in an inclusive range of 20 through 250 mm.

4. A power transformer/inductor according to claim 3, wherein:

the at least one winding surrounds a cross-section area, a circumference of each winding turn has a length, the electric connections between the n earthing points divide the cross-section area into n partial areas and divide said length into n segments, each partial area being bordered by a corresponding segment and at least one electric connection, and the electric connections between the n points are distributed in such a way that a ratio of a magnetic flux of any one of the n partial areas and a magnetic flux of the cross-section area is equal to a ratio of a length of a corresponding one of the n segments and the length of the circumference.

5. A power transformer/inductor according to claim 4, wherein:

a magnetic flux density is constant throughout a cross-section of the core, and the electric connections between the n points are distributed in such a way that a ratio of an area of any one of the n partial areas and the area of the cross-section area is equal to the ratio of the length of a corresponding one of the n segments and the length of the circumference.

6. A power transformer/inductor according to claim 1, further comprising:

a magnetizable core.

7. A power transformer/inductor according to claim 1, wherein the power transformer/inductor is built without a magnetizable core.

8. A power transformer/inductor according to claim 1, wherein:

the at least one winding being flexible and said layers adhere to each other.

9. A power transformer/inductor according to claim 8, wherein:

the layers are made of materials with an elasticity and coefficients of thermal expansion such that during operation changes in volume, due to temperature variations, are able to be absorbed by the elasticity of the materials such that the layers retain their adherence to each other during the temperature variations that appear during operation.

10. A power transformer/inductor according to claim 9, wherein:

the materials in the layers having a high elasticity with an E-module less than 500 MPa.

11. A power transformer/inductor according to claim 9, wherein:

the coefficients of thermal expansion being substantially equal.

12. A power transformer/inductor according to claim 9, wherein:

the layers are adhered to one another with a strength equal to or greater than a strength of a weakest material of the first semiconducting layer, the insulating layer and the second semiconducting layer.

13. A power transformer/inductor according to claim 12, wherein:

each semiconducting layer constitutes substantially an equipotential surface.

* * * * *